United States Patent [19]

Nakayama et al.

[11] Patent Number: 5,014,963

[45] Date of Patent: May 14, 1991

[54] VALVE APPARATUS FOR PREVENTING LEAKAGE OF A BEVERAGE

[75] Inventors: Shunichi Nakayama, Takasaki; Yasushi Takayanagi, Akabori, both of Japan

[73] Assignee: Sanden Corporation, Gunma, Japan

[21] Appl. No.: 433,266

[22] Filed: Nov. 8, 1989

[30] Foreign Application Priority Data

Nov. 8, 1988 [JP] Japan ..... 63-280467
Nov. 8, 1988 [JP] Japan ..... 63-280468

[51] Int. Cl.[5] ..... F16K 31/44

[52] U.S. Cl. ..... 251/245; 251/244; 251/285; 251/291

[58] Field of Search ..... 251/244, 245, 246, 285, 251/291

[56] References Cited

U.S. PATENT DOCUMENTS

| | | | |
|---|---|---|---|
| 54,722 | 5/1866 | Henke | 251/244 |
| 1,318,120 | 10/1919 | Wheaton | 251/291 X |
| 1,538,194 | 5/1925 | Levedahl | 251/245 |
| 1,924,637 | 8/1933 | Carpenter | 251/246 X |
| 2,019,257 | 10/1935 | Gibbs | 251/246 |
| 2,659,385 | 11/1953 | Hayden | 251/246 X |
| 3,195,566 | 7/1965 | Cornelius | 251/245 X |
| 3,419,246 | 12/1968 | Burgess | 251/285 X |
| 4,493,441 | 1/1985 | Sedam et al. | 222/129.1 |
| 4,493,443 | 1/1985 | Bailey | 251/291 X |
| 4,688,701 | 8/1987 | Sedam | 222/129.1 |

*Primary Examiner*—John Rivell
*Attorney, Agent, or Firm*—Banner, Birch, McKie & Beckett

[57] ABSTRACT

In a valve apparatus comprising a controlling arrangement which is for controlling a flow of a beverage in a beverage path, the controlling arrangement comprises a valve member which is movable between an open and a close position for opening and closing the beverage path and which is urged to the close position through a force transmission member by a compression spring. When the force transmission member is moved against the urging arrangement, the valve member becomes movable towards the open position. However, movement of the valve member is restricted at the open position by a stopper. Preferably, the stopper has a position which can be adjusted by operating of an operator or a user.

10 Claims, 5 Drawing Sheets

VALVE APPARATUS FOR PREVENTING LEAKAGE OF A BEVERAGE

BACKGROUND OF THE INVENTION

This invention relates to a valve apparatus included in a dispensing unit for dispensing a beverage, such as a syrup or the like, in particular, to controlling of a flow of the beverage.

Various dispensing units of the type are already known. For example, a dispensing unit as a post-mixed beverage dispenser is disclosed in U.S. Pat. Nos. 493,441 and 4,688,701 issued to Jason K. Sedam et al and assigned to The Coca-Cola Company. The dispensing unit is for dispensing a beverage contained in a bottle and comprises a valve apparatus for controlling of a flow of the beverage. The valve apparatus comprises a body defining a plurality of beverage paths which is for conducting the beverage.

Each of the beverage paths has an inlet end, an outlet end, and an intermediate portion therebetween. The beverage is introduced into the inlet end and is discharged from the outlet end through the intermediate portion.

Each of the beverage paths is provided with an adjusting element in addition to valve mechanism which is for opening and closing it. The adjusting element is for adjusting a flow rate of the beverage in the beverage path. Each of the valve element and adjusting element extends through the body from the intermediate portion to a front end of the body. The valve element can be operated by an operating lever which is provided on a front end of the body. The adjusting element can also be operated at the front end of the body.

It is advantageous that the beverage dispenser can be placed in a limited space because an external form of the beverage dispenser may be compact.

However, it is assumed that the beverage leaks from each of the beverage paths of the valve apparatus through clearances which are left around the valve and the adjusting elements, respectively. In order to seal all of the clearances, a plurality of sealing elements must be provided in relation to each of the beverage paths. Therefore, it is necessary to use a great number of the sealing elements. Nevertheless, there is great danger of leakage of the beverage.

In addition, the valve apparatus is relatively large in a size thereof. This is because the valve and the adjusting elements are placed at positions which are different from one another.

SUMMARY OF THE INVENTION

It is therefore an object of the present invention to provide a valve apparatus which is readily capable of preventing a beverage from leakage thereof in spite of including an adjusting element as well as a valve element.

It is another object of this invention to provide a valve apparatus of the type described, which is capable of being manufactured in a small size.

Other objects of this invention will become clear as the description proceeds.

According to this invention, there is provided a valve apparatus for use in a dispensing unit for dispensing a beverage through a beverage path having a particular portion. The valve apparatus includes a valve body defining the beverage path, controlling means coupled to the particular portion for controlling a flow of the beverage in the particular position, and operating means coupled to the valve body and the controlling means for operating the controlling means. In the valve apparatus, the controlling means comprises a valve member, a force transmission member, urging means, and restriction means. The valve member is coupled to the valve body and is movable, in a predetermined direction, between an open and a close position which are for opening and closing the particular portion, respectively. The valve member has a first end facing the particular portion and a second end opposite to the first end in the predetermined direction. The force transmission member is coupled to the valve body and the operating means and is movable in the predetermined direction. The force transmission member faces the second end of the valve member in the predetermined direction. The urging means is coupled to the valve body and the force transmission member and is for urging the force transmission member towards the second end of the valve member to locate the valve member at the close position. The restriction means is coupled to the valve body and is for restricting movement of the valve member in a predetermined sense which is opposite to the urging means. The restriction member determines the open position.

DESCRIPTION OF THE PREFERRED EMBODIMENT

Figure 1:
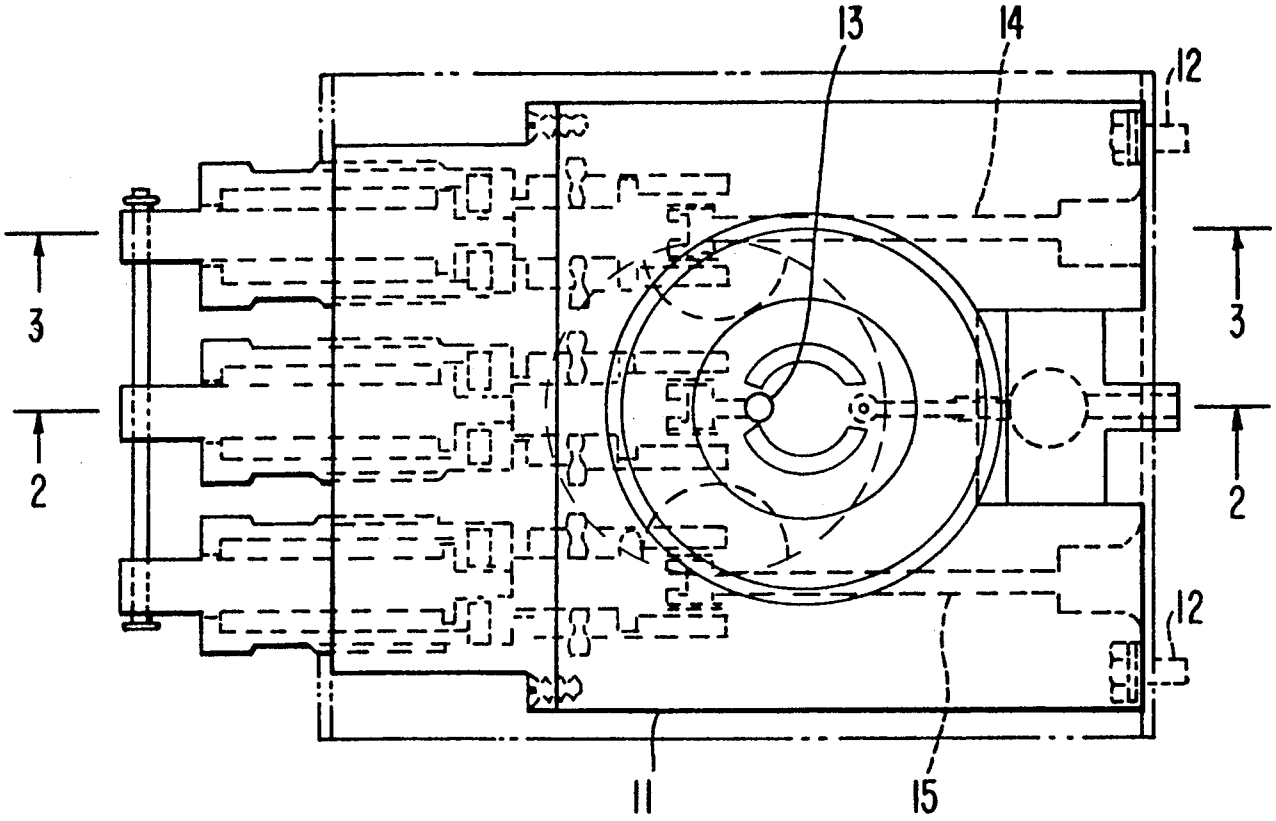
FIG. 1 is a plan view of a dispensing unit including a valve apparatus according to an embodiment of this invention.

Referring to FIGS. 1 through 4, a valve apparatus according to an embodiment of the present invention is for use in a dispensing unit which is for dispensing a beverage, such as a syrup drink diluted with dilution water and/or carbonated water in the manner known in the art. The valve apparatus comprises a body 11 which is fixed to a frame (not shown) of the dispensing unit by bolts 12 and which will be referred to as a local body or body member. The body 11 defines a syrup path 13 at a central position thereof and dilution water and carbonated water paths 14 and 15 which are placed at left and right sides thereof, respectively. Each of the syrup, the dilution water, and the carbonated water paths 13, 14, and 15 is referred to as a beverage path and is communicated with a nozzle 16 which is provided at a lower end of the body 11. The body 11 may be made of a combination of various parts.

The syrup path 13 has, an upper end thereof, a connecting opening 17 connected to a syrup bottle 18 which is placed on an upper portion of the body 11. The syrup bottle 18 is removable from the body 11 The dilution water path 14 is connected to a dilution water source (not shown) through a dilution water pipe (not shown). Similarly, the carbonated water path 15 is connected to a carbonated water source (not shown). Therefore, it is possible to discharge the syrup, the dilution water, and carbonated water through the nozzle 16.

The syrup path 13 has, between the nozzle 16 and the connecting opening 17, an intermediate portion as a particular portion provided with a valve mechanism 22 which is capable of opening and shutting the syrup path 13. Each of the dilution and the carbonated paths 14 and 15 is provided with another valve mechanism 23 which is similar to the valve mechanism 22.

Description will proceed to only the first-mentioned valve mechanism 22 because those valve mechanisms are similar to one another. A valve hole 11*a* is made in the body 11 to communicate with the particular portion of the syrup path 13. The valve mechanism 22 comprises valve and force transmission members 24 and 25. The valve member 24 is placed in the valve hole 11*a* to be movable in each of first and second senses 26 and 27 which are opposite to one another. The valve member 24 has a packing 28 at an end thereof in the second sense 27. The packing 28 faces the intermediate portion of the syrup path 13 and is for opening or closing the syrup path 13 with the valve member 16 moved in each of the first and the second senses 26 and 27. The valve member 24 is urged in a first sense 26 by a first compression spring 29 which is as additional urging arrangement between the body 11 and the valve member 24.

A sealing member 30 is fixed to the body 12 and is in slidable contact with the valve member 24 to seal a gap 31 left therebetween. It is to be noted in this connection that FIG. 1 illustrates a case where the valve member 24 is placed at a close position at which the syrup path 13 is closed at a particular portion thereof by the valve member 24.

The valve apparatus further comprises an adjusting screw 32 of a cylindrical tube which defines a through hole 32*a*. The adjusting screw 32 is screwed in a cylindrical screw hole 11*b* which is made in the body 11 as a through hole to communicate with the valve hole 11*a*. Therefore, the adjusting screw 32 has a position which is adjustable in the first and the second senses 26 and 27 by rotation thereof. In addition, it is readily possible by a small force to operate the adjusting screw 32. A combination of the body 11 and the adjusting screw 32 is referred to as a valve body.

The force transmission member 25 is inserted in the adjusting screw 32 and extends in the first and the second senses 26 and 27 to have first and second ends 25*a* and 25*b* which extend outside of the adjusting screw 32 in the first and the second senses 26 and 27.

A second compression spring 33 is placed inside the adjusting screw 21 and is referred to as urging arrangement. The second compression spring 33 is for urging the force transmission member 25 in the second sense 27. As a result, the first end 25*a* of the force transmission member 25 is brought in press contact with the valve member 24 to push the valve member 24 towards the close position. In this connection, the second compression spring 33 has an urging force which is greater than that of the first compression spring 29. Therefore, the valve member 24 is placed at an open position to open the syrup path 13 when the force transmission member 25 is not received with external force.

A stopper 34 is fixed to an axial end of the adjusting screw 32 to be movable in each of the first and the second senses 26 and 27 dependent on the adjusting screw 32. The stopper 34 is for determining the open position. At the open position, the valve member 24 is in engagement with the stopper 34 in the first sense 26. In this connection, it is a matter of course that the valve member 24 opens the syrup path 13. The open position can be moved in each of the first and the second senses 26 and 27 by rotating the adjusting screw 32. Therefore, it is possible to adjust an opening of the syrup path 13 into a desired value thereof. The stopper 34 is referred to as a restriction arrangement.

The body 11 is provided with an operating lever 35 at a front surface thereof. The operating lever 35 has a middle portion rotatably supported to a supporting portion 36 through a horizontal shaft 37. A substantial end portion of the operating lever 35 is in removable engagement with a shaft 38 which is supported to the second end 25*b* of the force transmission member 25.

When the operating lever 35 is pushed as depicted at an arrow 39, the force transmission member 25 is moved in the first sense 26. In response, the valve member 24 is also moved in the first sense to open the syrup path 13. As a result, the syrup flows from the syrup bottle 18 into the syrup path 13 and then is supplied to the nozzle 16 through the water conduction member 41. In this event, movement of the operating lever 35 is detected with a detection switch 42 operated by an arm 43 which is fixed to the operating lever 35.

Although detailed description is omitted for simplification of the description, each of the dilution water and the carbonated water paths 14 and 15 comprises construction which are similar to that of the syrup path 13. Therefore, it is possible to supply the beverage of suitable mixing among the syrup, the carbonated water, and the dilution water through the nozzle 6. It is a matter of course that concentration of the beverage may be adjusted by each adjusting screw 32.

The syrup bottle 18 is of a cassette type which is detachably attached to the body 11. $CO_2$ gas can be supplied to the syrup bottle 18 through a gas path 44 and a gas tube (not shown) connected to the gas path 44. The gas path 44 is connected to a check unit 50 which will presently be described.

The check unit 50 comprises a unit body 51 fixed to the body 11 by screw members 52. The unit body 51 defines a space portion 53 which extends upwardly and downwardly. The space portion 53 has an upper opening and a lower opening which is closed by a cover member 54 screwed in the lower opening. The upper opening of the space portion 53 is connected to an inlet port 56 which is for being connected to the gas tube. The space portion 53 has a lower portion communicated with the syrup bottle 18 through the gas path 44. As a result, a combination of the gas path 44 and the space portion 53 is formed in a U-shape as will become clear from FIG. 2.

The check unit 50 further comprises first and second check valves 61 and 62 which are arranged in series in the space portion of the unit body 51. The first check valve 61 is placed at a high position. The second check valve 62 is placed at a low position which is lower than the high position.

The first check valve 61 comprises valve seat and valve body members 63 and 64. The valve seat member 63 is fixed to the unit body 51. The valve body member 64 is held in a central portion of the valve seat member 63. A seal ring 65 is for sealing a clearance around the valve seat member 63.

The valve seat member 63 has a plurality of small through holes 66 which are arranged along a circle.

Each of the small through holes 66 is for permitting the $CO_2$ to gas pass therethrough. On the other hand, the valve body member 64 is of rubber and comprises a flange portion 67 which faces the small through holes 66. The flange portion 67 is for checking the $CO_2$ gas flow upwardly. It is a matter of course that the first check valve 61 permits the $CO_2$ gas flow downwardly.

Although detailed description is omitted for simplification of the description, the second check valve 62 comprises structure which is similar to that of the first check valve 62. A numeral 68 is representative of a filter which is well known in the art.

With this structure, a counterflow of the syrup is surely prevented by the first and the second check valves 61 and 62.

Figure 2:
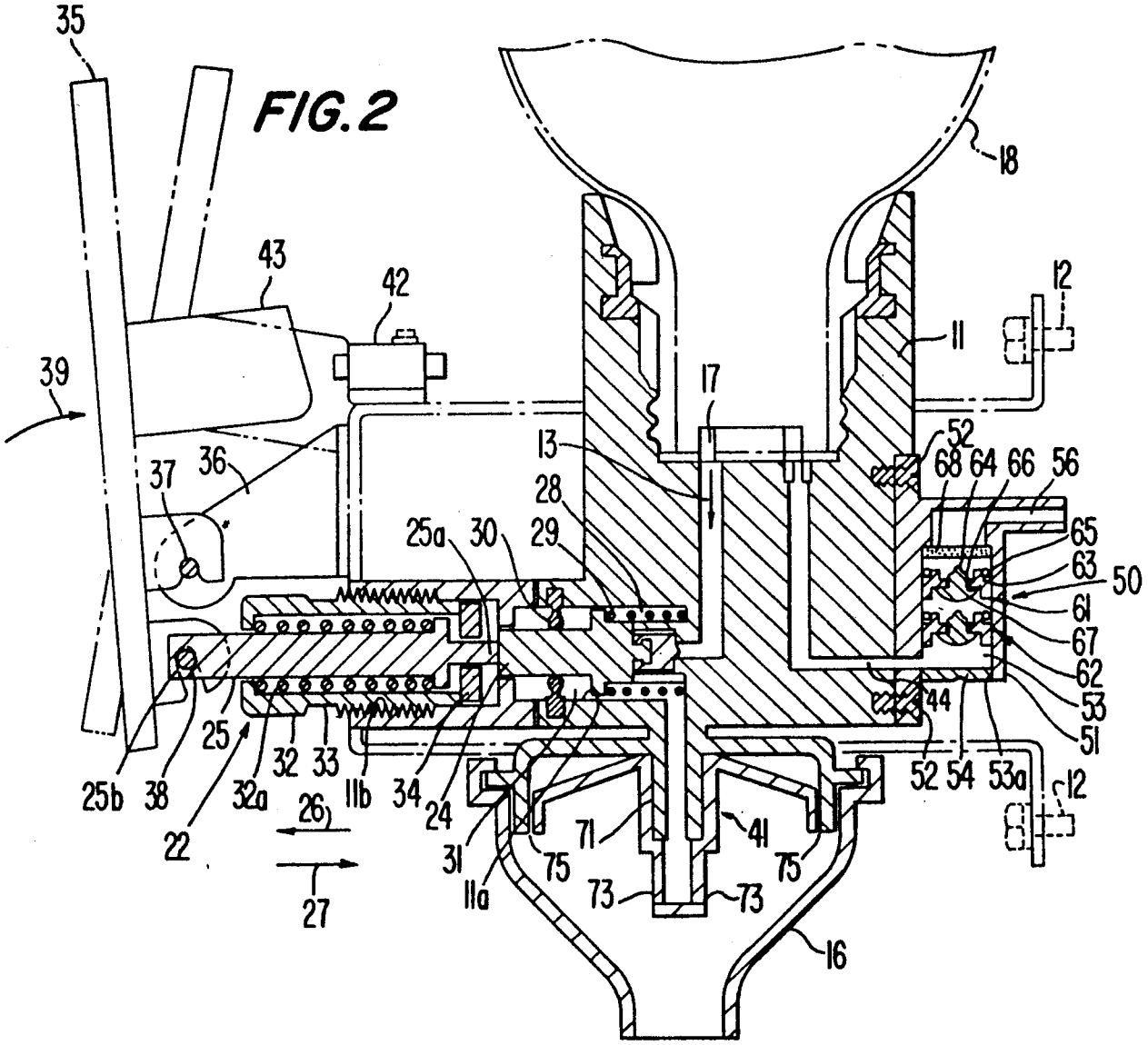
FIG. 2 is a sectional view of the dispensing unit taken along a line 2—2 in FIG. 1.
Figure 3:
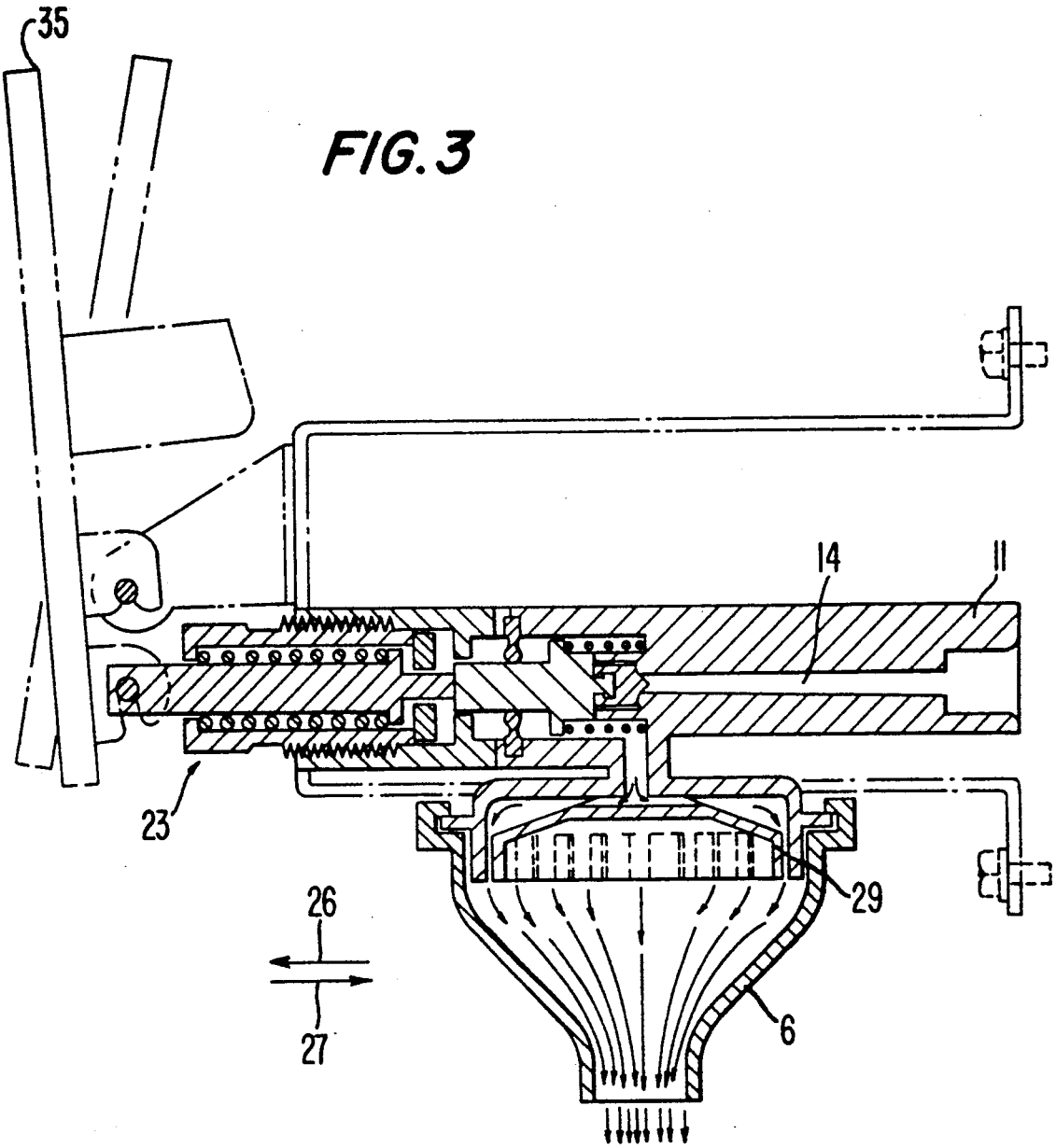
FIG. 3 is a sectional view of a part of the dispensing unit taken along a line 3—3 in FIG. 1.
Figure 5:
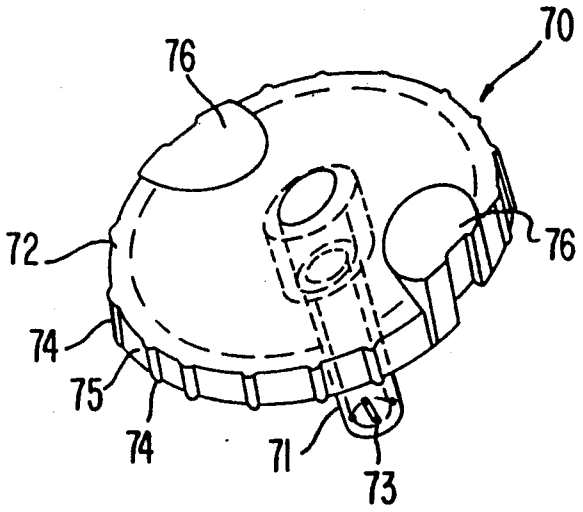
FIG. 5 is a perspective view of a water conduction member included in the dispensing unit of FIG. 1.
Figure 4:
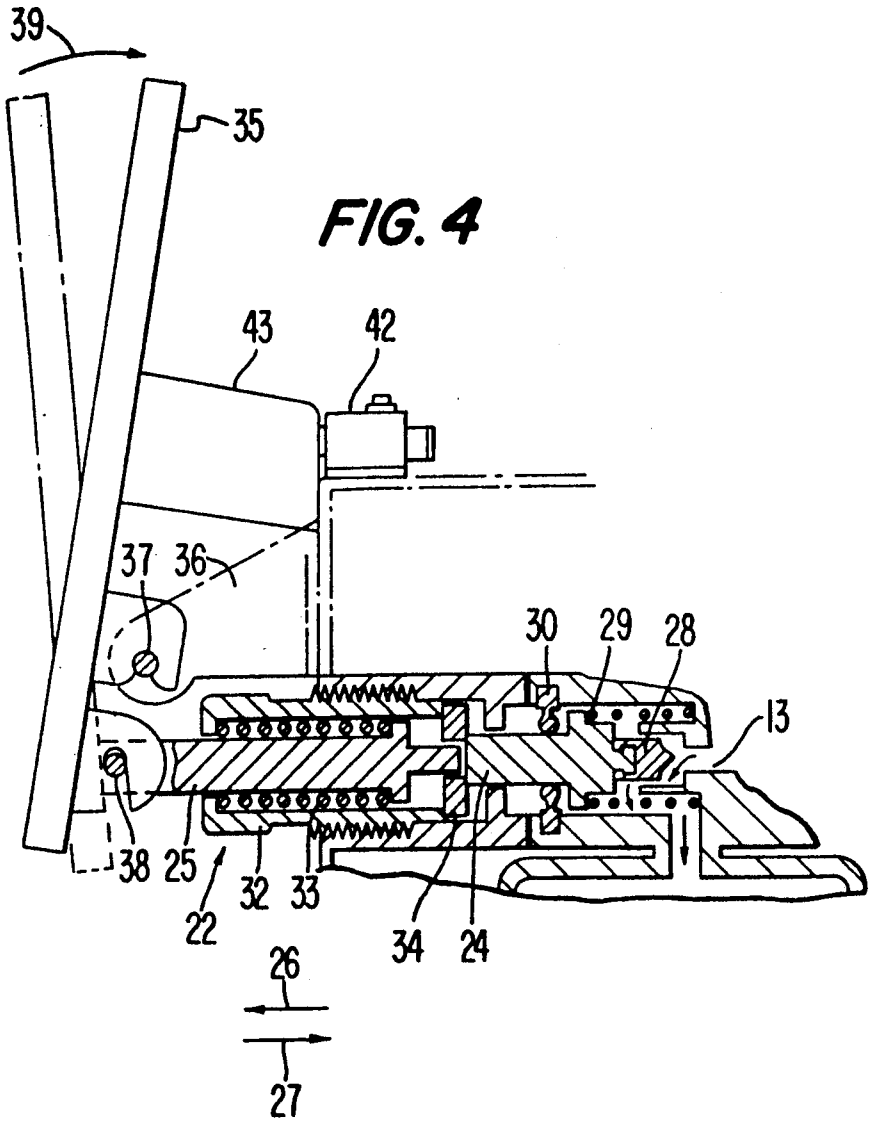
FIG. 4 is a sectional view for use in describing operation of the dispensing unit illustrated in FIG. 1.

Referring to FIG. 5 together with FIGS. 2 and 3, the water conduction member 70 comprises a cylindrical portion 71 of a central portion thereof, and a plate portion 72 which outwardly extends from an end of the cylindrical portion 71. The cylindrical portion 71 is communicated with the syrup path 13 and defines a plurality of discharging ports 73 which are radially directed at the vicinity of a lower end thereof. Therefore, the syrup is discharged inside the nozzle 16 through each of the discharging ports 73.

The plate portion 72 has a plurality of projections 74 formed on a peripheral surface thereof. Two adjacent ones of the projections 74 produce a groove 75 therebetween. The plate portion 72 comprises two table portions 76 which are placed at an upper surface thereof with an angular space left therebetween. Each of the table portions 76 has an upper surface which is flat.

The water conduction member 41 is fixedly placed in the nozzle 16 so that the table portions 76 face outlet ends of the dilution and the carbonated paths 14 and 15, respectively.

When the dilution and the carbonated water are discharged from the outlet ends of the dilution water and the carbonated water paths, they collide with the upper surfaces of the table portions 76 to thereby be spread in various directions. After that, the dilution and the carbonated water are discharged inside the nozzle 16 through the grooves 75. As a result, the syrup is enveloped in the dilution and the carbonated water in the nozzle 16. Therefore, mixing is favorably carried out between the syrup, the dilution water, and the carbonated water.

Figure 6:
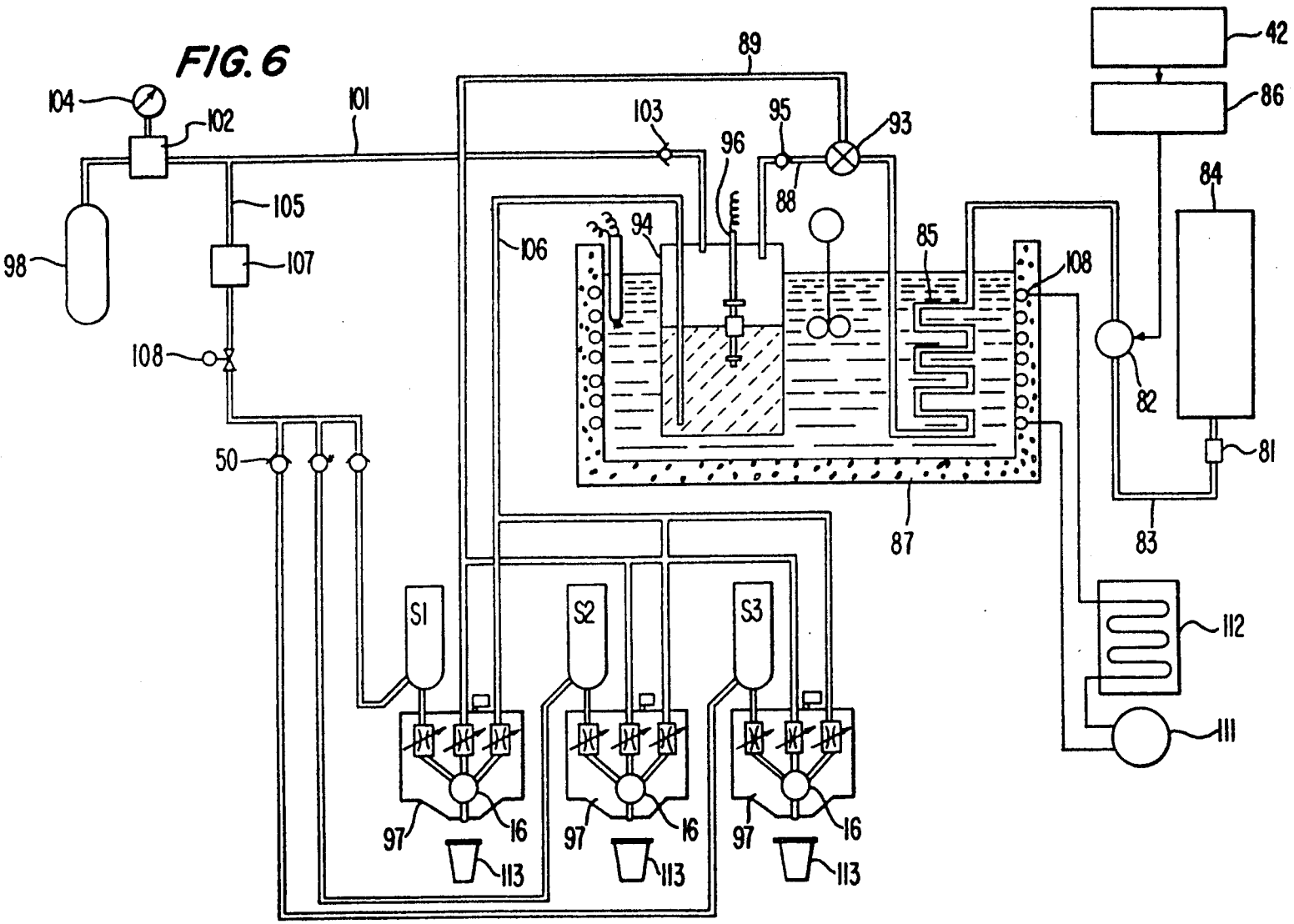
FIG. 6 is a view for use in describing a dispensing unit comprising the valve apparatus illustrated in FIG. 1.

Attention will be directed to the dispensing unit referring to FIG. 6. The dispensing unit comprises a coupler 81 connected to a pump 82 through a first supplying pipe 83. The coupler 81 is for removably connecting a portable tank 84 to the supplying pipe 83 and has a function in which the supplying pipe 83 is closed when the portable tank 84 is removed from the coupler 81. The portable tank 84 is for containing a drinking water.

The pump 82 is connected to an end of a refrigerant pipe 85 and has operation which is controlled by a control unit 86 with reference to operation of the detection switch 42. The refrigerant pipe 85 is passed through a refrigerant water contained in a refrigerant water tank 87. Second and third supplying pipes 88 and 89 are connected to another end of the refrigerant pipe 85 through an electromagnetic three-way-valve 93 which is well known in the art. The second supplying pipe 88 is connected to a carbonator 94 through a check valve 95. The carbonator 94 is provided with a float switch 96 therein.

The dispensing unit further comprises three valve apparatus 97 which are similar to the above-mentioned valve apparatus shown in FIGS. 1 through 4. The third supplying pipe 89 is connected to the dilution water path 14 (FIG. 3) of each of the valve apparatus 97. More particularly, the third supplying pipe 89 is branched into a plurality of pipe portions which are connected to the valve apparatus 97, respectively.

A $CO_2$ tank 98 is connected to the carbonator 94 through a gas pipe 101. The carbonated water is produced from a drinking water and the $CO_2$ gas in the carbonator 94. The gas pipe 101 is provided with reducing and check valves 102 and 103 which are inserted thereto. The reducing valve 102 is provided with an indicator 104 which is for indicating a primary pressure of the gas pipe 101. The reducing valve 102 is for reducing a pressure of the $CO_2$ gas into 0.4 $kg/cm^2$.

A branched pipe 105 is connected to the gas pipe 101 between the reducing and the check valves 102 and 103. The branched pipe 105 extends through the reducing valve 107 and an operating cock 108 and is branched into a plurality of pipe portions which are connected to syrup tanks S1, S2, and S3, respectively. Each of the syrup tanks S1, S2, and S3 corresponds to the above-mentioned syrup bottle 18 shown in FIG. 2. The syrup tanks S1, S2, and S3 are connected to the valve apparatus 97, respectively.

The carbonated water can be taken from the carbonator 94 through the pipe 106. The pipe 106 is branched into a plurality of pipe portions which are connected to the carbonated water paths of the valve apparatus 97, respectively.

The refrigerant water tank 87 is provided with an evaporator 108 which extends along an internal surface thereof. As will be known in the art, the evaporator 108 is included in a refrigerant circuit which comprises a compressor 111 and a condenser 112. In this connection, the refrigerant water has a temperature which is controlled in the refrigerant water tank 87 to be about 0°.

Description will be made about operation of the dispensing unit. When predetermined operation is carried out after a cup 113 is placed on a tray (not shown), the detection switch 42 is operated to thereby actuate both of the pump 82 and the three-way-valve 93. The pump 82 supplies the drinking water to the carbonator 94 and the valve apparatus 97. Responsive to supplying of the drinking water, the carbonator 94 produces the carbonated water to thereby supply the carbonated water to the valve apparatus 97. As a result, the drinking water, the carbonated water, and the syrup are supplied to the valve, apparatus.

When the float switch 96 detects a decrease of the water level in the carbonator 94, the pump 82 is driven to supply the drinking water into the carbonator 94. In this event, the three-way-valve 93 is not driven.

What is claimed is:

1. In a valve apparatus for use in a dispensing unit for dispensing a beverage through a beverage path having an intermediate portion, said valve apparatus including a valve body defining said beverage path, controlling means coupled to said intermediate portion for controlling a flow of said beverage in said intermediate portion, and operating means coupled to said valve body and said controlling means for operating said controlling means, said controlling means comprising:

a valve member coupled to said valve body and movable, in a predetermined direction, between an open and a closed position to open and close said intermediate portion, said valve member having a first end facing said intermediate portion and a second end opposite said first end;

a force transmission member coupled to said valve body and said operating means and movable in said predetermined direction, said force transmission member facing the second end of said valve member;

urging means coupled to said valve body and said force transmission member for urging said force transmission member towards the second end of said valve member to locate said valve member at said closed position; and restriction means coupled to said valve body for restricting movement of said valve member in a direction opposite to said urging means, said restriction means determining said open position, and said valve body comprising:

a body member defining said beverage path; and adjusting means coupled to said body member and said restriction means for adjusting a position of said restriction means in said predetermined direction, said adjusting means comprising a cylindrical portion defining a through hole extending in said predetermined direction, said force transmission member extending through said through hole, said urging means being placed in said through hole with ends which are in engagement with said adjusting means and said force transmission member, respectively.

2. A valve apparatus as claimed in claim 1, further comprising additional urging means coupled to said valve body and said valve member for urging said valve member towards said open position.

3. A valve apparatus as claimed in claim 1, wherein said valve body has an inner surface extending in said predetermined direction to define, a valve hole which is connected to the intermediate portion of said beverage path, said valve member being placed in said valve hole to be movable in said predetermined direction.

4. A valve apparatus as claimed in claim 3, wherein said valve member has an outer surface opposite to said inner surface with a gap between said outer surface and said inner surface of said valve body, said valve apparatus further comprising sealing means between said valve body and said valve member for sealing said gap.

5. A valve apparatus as claimed in claim 4, wherein said sealing means extends along the outer surface of said valve member to form a ring shape, said sealing means being fixed to said valve body and having an inner peripheral surface which is in slidable contact with the outer surface of said valve member.

6. A valve apparatus as claimed in claim 3, wherein said valve body further defines a through hole extending in said predetermined direction which communicates with said valve hole, said force transmission member extending through said through hole and having an end which faces the second end of said valve member.

7. A valve apparatus as claimed in claim 6, wherein said force transmission member has another end which is removably connected to said operating means.

8. A valve apparatus as claimed in claim 6, wherein said urging means is placed in said through hole and has ends which are in engagement with said valve body and said force transmission member, respectively.

9. A valve apparatus as claimed in claim 1, wherein said body member further defines a cylindrical hole extending in said predetermined direction, said adjusting means being placed in said cylindrical hole to be movable in said predetermined direction, said restriction means being fixed to said adjusting means.

10. A valve apparatus as claimed in claim 1, wherein said force transmission member has another end which is removable connected to said operating means.

* * * * *